US011566410B2

(12) United States Patent
Eto et al.

(10) Patent No.: US 11,566,410 B2
(45) Date of Patent: Jan. 31, 2023

(54) FLUSH TOILET

(71) Applicant: TOTO LTD., Kitakyushu (JP)

(72) Inventors: Yusuke Eto, Kitakyushu (JP); Takahiro Maruyama, Kitakyushu (JP); Wataru Ishimi, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 17/678,207

(22) Filed: Feb. 23, 2022

(65) Prior Publication Data

US 2022/0275626 A1 Sep. 1, 2022

(30) Foreign Application Priority Data

Feb. 26, 2021 (JP) ..... JP2021-030143

(51) Int. Cl.

| | |
|---|---|
| ***E03D 11/13*** | (2006.01) |
| ***E03D 11/18*** | (2006.01) |
| ***E03D 1/26*** | (2006.01) |
| ***E03D 5/01*** | (2006.01) |

(52) U.S. Cl.

CPC ..... *E03D 11/13* (2013.01); *E03D 1/26* (2013.01); *E03D 11/18* (2013.01); *E03D 5/01* (2013.01)

(58) Field of Classification Search

CPC ..... E03D 11/13; E03D 1/26; E03D 11/18; E03D 5/01; E03D 2201/30; E03D 11/08; E03D 11/02; E03D 11/06; E03D 11/17

USPC ..... 4/332

See application file for complete search history.

(56) References Cited

FOREIGN PATENT DOCUMENTS

| | | |
|---|---|---|
| CN | 211735633 U | 10/2020 |
| JP | 2017-89282 A | 5/2017 |
| JP | 2020-204261 A | 12/2020 |

*Primary Examiner* — Christine J Skubinna
(74) *Attorney, Agent, or Firm* — BakerHostetler

(57) ABSTRACT

A flush toilet includes a toilet main body made of ceramics including a skirt and a rear storage configured to store at least a part of a control unit. The skirt includes a rear wall and a side wall provided in a back surface and a side surface of the toilet main body, respectively. The rear wall includes an opening provided between a peripheral edge of each opening and the side wall of the skirt. The opening penetrates in a front-rear direction to communicate between an inner region of the rear storage or an outer region below the inner region and an outer region behind the toilet main body. The skirt further includes a cross beam that joinably or coupleably supports the peripheral edge of the opening and the side wall of the skirt to each other so as to reinforce strength of the toilet main body.

10 Claims, 7 Drawing Sheets

FLUSH TOILET

CROSS REFERENCE TO RELATED APPLICATION

This application claims benefit of priority to Japanese Patent Application No. 2021-030143, filed on Feb. 26, 2021, the entire content of which is incorporated herein by reference.

FIELD OF THE INVENTION

The present invention relates to a flush toilet, and more particularly, to a flush toilet which is flushed with flush water to discharge waste.

BACKGROUND OF THE INVENTION

Conventionally, as a flush toilet which is flushed with flush water to discharge waste, there is known, for example, as described in Patent Document 1 (Japanese Patent Laid-Open No. 2020-204261), Patent Document 2 (Chinese Utility Model No. 211735633) and Patent Document 3 (Japanese Patent Laid-Open No. 2017-89282), a so-called "full skirt" or "total Hakama" flush toilet in which a skirt formed on an outer side than a side surface of each of a bowl of a toilet main body made of ceramic and a water discharge trap is formed all around the toilet main body, and formed seamlessly in terms of designability of the toilet main body.

In a conventional "full skirt" or "total Hakama" flush toilet described in each of Patent Documents 1 to 3, a storage section that is available for storing a control unit including a function of controlling discharging and stopping of flush water to a bowl of a toilet main body is provided in a region more rearward than the bowl of the toilet main body, and four sides of this storage section are surrounded with ceramics. Also, in the above conventional "full skirt" flush toilet, an opening is provided penetrating a rear wall of a skirt provided behind the storage section of the control unit in the toilet main body. Through this opening in the rear wall of the skirt, the control unit in the storage section of the toilet main body can be accessed from outside a rear side of the toilet main body.

On the other hand, one of aims that have been requested to be achieved in recent years with design diversification of the flush toilet and improvement in design such as appearance of the flush toilet is to acquire a large storage region that stores a control unit in a region more rearward than a bowl of a toilet main body, while reducing (slimming) an external dimension of the whole toilet main body. Particularly, in the so-called "full skirt" or "total Hakama" flush toilet, in terms of designability and functionality, many sloped or curved surfaces are adopted for an outer surface shape or the like of the skirt, and hence one of requested aims is to ensure a storage region of the control unit while ensuring designability of the toilet main body. However, in this "full skirt" or "total Hakama" flush toilet, as a size of the opening itself is designed to be large to improve accessibility from outside through the opening in the rear wall of the skirt to the control unit in the storage section, deformation such as distortion might occur in the opening itself, or deformation such as distortion might occur in a peripheral portion of the opening in the skirt. Consequently, there is a problem that the whole toilet main body lacks strength. Therefore, another requested aim is to suppress lack of strength in the toilet main body, while acquiring a moderate size of the opening in the rear wall of the skirt of the toilet main body.

Also, there is a problem that as a thickness of the skirt in which the opening is formed increases to make up for the lack of strength in the opening in the rear wall of the skirt of the toilet main body or the peripheral portion of the opening, the storage region of the control unit that is adjacent to the opening is reduced, or there is a problem that the thick skirt is hard to be held when moving the toilet main body during transport or conveyance or during construction. Therefore, still another requested aim is to set a moderate thickness of the skirt or the like of the toilet main body, while acquiring the storage region of the control unit in the toilet main body as large as possible.

Accordingly, the present invention is aimed at solving problems of the conventional arts described above and is aimed at providing a flush toilet which can suppress lack of strength in an opening in a rear wall of a skirt of a toilet main body made of ceramics and a peripheral portion of the opening, and which can acquire a large storage region of a control unit in the toilet main body.

SUMMARY OF THE INVENTION

To solve the problems described above, an aspect of the present invention is a flush toilet comprising: a toilet main body made of ceramics, the toilet main body including a bowl configured to receive waste and a water discharge trap configured to discharge the waste in the bowl, the water discharge trap including an inlet connected to a lower portion of the bowl, a control unit provided more rearward than the bowl of the toilet main body, the control unit being configured to control discharge and stopping of flush water to the bowl, and wherein the toilet main body further includes a skirt and a rear storage configured to store at least a part of the control unit, the skirt being formed on an outer side of side surfaces of the bowl and the water discharge trap, and a rear storage being provided inside the skirt in a region more rearward than the bowl, the skirt includes a rear wall and a side wall provided in a back surface and a side surface of the toilet main body, respectively, and the rear wall includes an opening provided penetrating in a front-rear direction to communicate between an outer region behind the toilet main body and an inner region of the rear storage or an outer region below the inner region and, and the skirt further includes a cross beam provided between a peripheral edge of the opening and the side wall of the skirt, and the cross beam joinably or coupleably supports the peripheral edge of the opening and the side wall of the skirt to each other so as to reinforce strength of the toilet main body. According to the aspect of the present invention having this configuration, the cross beam provided between the peripheral edge of the opening in the rear wall of the skirt and the side wall of the skirt can joinably or coupleably support the peripheral edge of the opening and the side wall of the skirt and can reinforce the strength of the toilet main body. Consequently, even when a thickness of the rear wall or the side wall of the skirt is not increased, the cross beam can suppress deformation such as distortion of the opening itself, or suppress cuts, cracks or the like in a peripheral portion of the opening due to insufficient strength, so that lack of strength in the toilet main body can be suppressed, while acquiring a large storage region of the rear storage of the toilet main body.

In the aspect of the present invention, preferably, the rear wall or the side wall of the skirt forms a double wall including an outer wall and an inner wall, the outer wall forms an outer surface of the double wall, the inner wall is provided inside the outer wall, and the double wall has at least a part forming an internal space between the outer wall and the inner wall, a peripheral portion of the opening is formed by the double wall, and the cross beam joinably or coupleably supports the inner wall of the double wall and the peripheral edge of the opening. According to the aspect of the present invention having this configuration, the rear wall or the side wall of the skirt is formed by the double wall including the inner wall and the outer wall, so that the rear wall or the side wall of the skirt can be formed in a complicated shape and can have increased strength. Also, the cross beam can joinably or coupleably support the double wall and the peripheral edge of the opening, the double wall having comparatively high strength. This can effectively suppress deformation such as distortion of the opening itself and cuts, cracks or the like in the peripheral portion of the opening due to the insufficient strength.

In the aspect of the present invention, preferably, the opening includes a protruding edge having one of a top or a bottom, the protruding edge substantially protrudes in an arch in back view, the arched protruding edge includes a linear portion and a curved portion, the linear portion linearly extends from a start end of each of opposite left and right end portions of the protruding edge toward a terminal end in a center of the rear wall of the skirt in an up-down direction or a left-right direction, and the curved portion curves upward or downward from the terminal end of the linear portion, and the cross beam is disposed closer to the curved portion side than to a connecting portion between the linear portion and the curved portion, the connecting portion having a comparatively large curvature change, and the cross beam is provided to be joinable or couplable between the protruding edge of the opening and the side wall of the skirt. According to the aspect of the present invention having this configuration, the cross beam is disposed closer to the curved portion side than to the connecting portion between the linear portion and the curved portion, the connecting portion having the comparatively large curvature change, in the arched protruding edge of the opening, and the cross beam is provided to be joinable or couplable between the protruding edge of the opening and the side wall of the skirt. This can more effectively suppress deformation such as distortion of the arched protruding edge of the opening having the comparatively large curvature change, and cuts, cracks or the like in the peripheral portion of the opening due to insufficient strength.

In the aspect of the present invention, preferably, the skirt includes a vertical beam between the rear wall and the side wall so as to joinably or coupleably support the rear wall and the side wall. According to the aspect of the present invention having this configuration, since the skirt includes the vertical beam that joinably or coupleably supports the rear wall and the side wall, between the rear wall and the side wall in the skirt, so that the vertical beam can suppress deformation such as distortion of the opening, and cuts, cracks or the like in the peripheral portion of the opening due to the insufficient strength. Furthermore, the cross beam can reinforce strength of a joining portion between the rear wall and the side wall in the skirt, so that deformation such as distortion of the rear wall or side wall of the skirt and damages due to insufficient strength can be suppressed.

In the aspect of the present invention, preferably, the vertical beam is provided to be joinable or couplable to the cross beam. According to the aspect of the present invention having this configuration, the vertical beam is also provided to be joinable or couplable to the cross beam, so that the vertical beam can reinforce strength of the cross beam. Consequently, deformation such as distortion of the opening itself and cuts, cracks or the like in the peripheral portion of the opening due to the insufficient strength can be more effectively suppressed. Also, the deformation, such as the distortion, of the rear wall or side wall of the skirt and damages due to the insufficient strength can be more effectively suppressed.

In the aspect of the present invention, preferably, the rear storage includes a supporting wall supporting the control unit, and the supporting wall forms a storage region configured to store the control unit above the supporting wall, and the cross beam is provided to be joinable or couplable to the supporting wall. According to the aspect of the present invention having this configuration, the cross beam is provided to be joinable or couplable to the supporting wall that forms the storage region that is available for storing the control unit above the supporting wall in the rear storage and that supports the control unit. Consequently, both of the supporting wall and the cross beam can more effectively suppress the deformation, such as the distortion, of the opening itself, and the cuts, cracks or the like in the peripheral portion of the opening due to the insufficient strength, and deformation such as distortion of the rear wall or side wall of the skirt and damages due to insufficient strength.

In the aspect of the present invention, preferably, the opening includes an upper opening and a lower opening disposed below the upper opening, and the upper opening penetrates the rear wall of the skirt in the front-rear direction to communicate between the inner region of the rear storage and the outer region behind the toilet main body, and the lower opening penetrates the rear wall of the skirt in the front-rear direction to communicate between an exit side region of the water discharge trap and the outer region behind the toilet main body. According to the aspect of the present invention having this configuration, the upper opening that communicates between the inner region of the rear storage and the outer region behind the toilet main body, and the lower opening that is disposed below the upper opening and that communicates between the exit side region of the water discharge trap and the outer region behind the toilet main body are provided to the rear wall of the skirt, so that operability through the upper opening and lower opening can improve. Consequently, a larger space for connecting the discharge socket, the drain pipe and the like to an exit of the water discharge trap can be acquired, and hence construction properties can improve. Also, through the upper opening in the rear wall of the skirt, the control unit stored in the rear storage can be disposed closer to the wall or the like behind the control unit, and a space behind the control unit can thus be effectively used. Furthermore, a larger storage region of the rear storage that stores the control unit can be acquired. Additionally, the strength can be increased, while suppressing a forward dimension of the whole toilet main body.

In the aspect of the present invention, preferably, a maximum dimension of the lower opening in an up-down direction is larger than a maximum dimension of the upper opening in the up-down direction. According to the aspect of the present invention having this configuration, the maximum dimension of the lower opening in the up-down direction is set to be larger than the maximum dimension of the upper opening in the up-down direction, so that a larger space on an exit side of the water discharge trap can be acquired. Consequently, for example, a larger space for connecting the discharge socket, the drain pipe or the like to the exit of the water discharge trap can be acquired, and hence the construction properties can improve. Also, through the upper opening in the rear wall of the skirt, the control unit stored in the rear storage can be disposed closer to the wall or the like behind the control unit, and the space behind the control unit can thus be effectively used. Furthermore, the larger storage region of the rear storage that stores the control unit can be acquired. Additionally, the strength can be increased, while suppressing the forward dimension of the whole toilet main body.

In the aspect of the present invention, preferably, the cross beam is provided above a lowermost surface of the upper opening or below an uppermost surface of the lower opening. According to the aspect of the present invention having this configuration, the cross beam is provided above the lowermost surface of the upper opening or below the uppermost surface of the lower opening, so that the cross beam can effectively suppress deformation such as distortion of the upper opening or the lower opening itself, and cuts, cracks or the like in a peripheral portion of the upper opening or the lower opening due to insufficient strength.

In the aspect of the present invention, preferably, a plurality of cross beams are provided to be joined to the peripheral edge of the opening, and the respective cross beams are arranged above or below each other. According to the aspect of the present invention having this configuration, the plurality of cross beams are provided to be joined to the peripheral edge of the opening, and the respective cross beams are arranged above or below each other, so that the cross beams can effectively suppress deformation such as distortion of the opening itself, and cuts, cracks or the like in the peripheral portion of the opening due to insufficient strength. Therefore, lack of strength in the whole toilet main body can be suppressed.

According to the flush toilet of the aspect of the present invention, the lack of strength in the opening in the rear wall of the skirt of the toilet main body made of ceramics and the peripheral portion of the opening can be suppressed, and the large storage region of the control unit in the toilet main body can be acquired.

DETAILED DESCRIPTION OF THE PREFERRED EMBODIMENT

Figure 1:
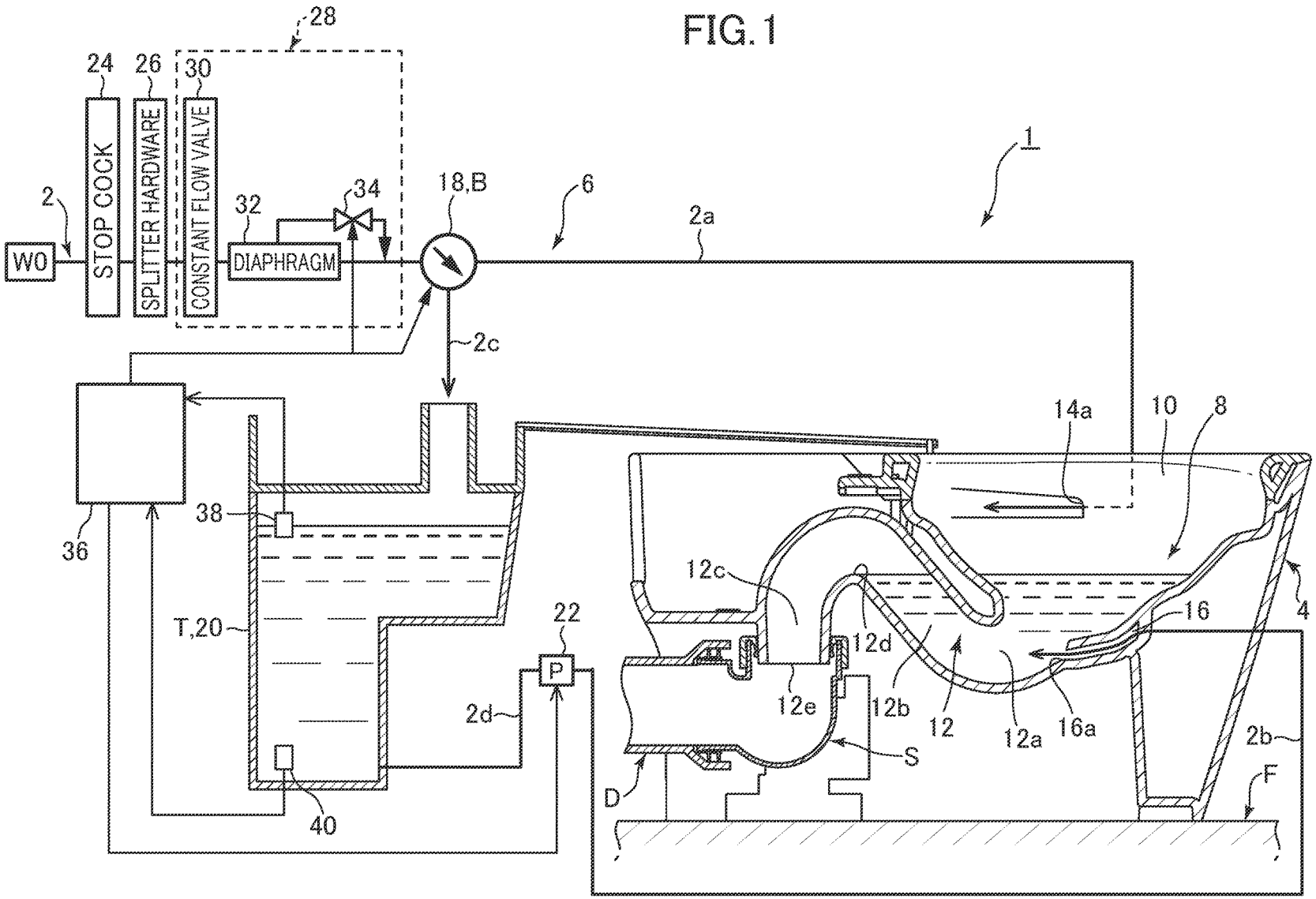
FIG. 1 is an overall structural diagram of a flush toilet according to an embodiment of the present invention.
Figure 2:
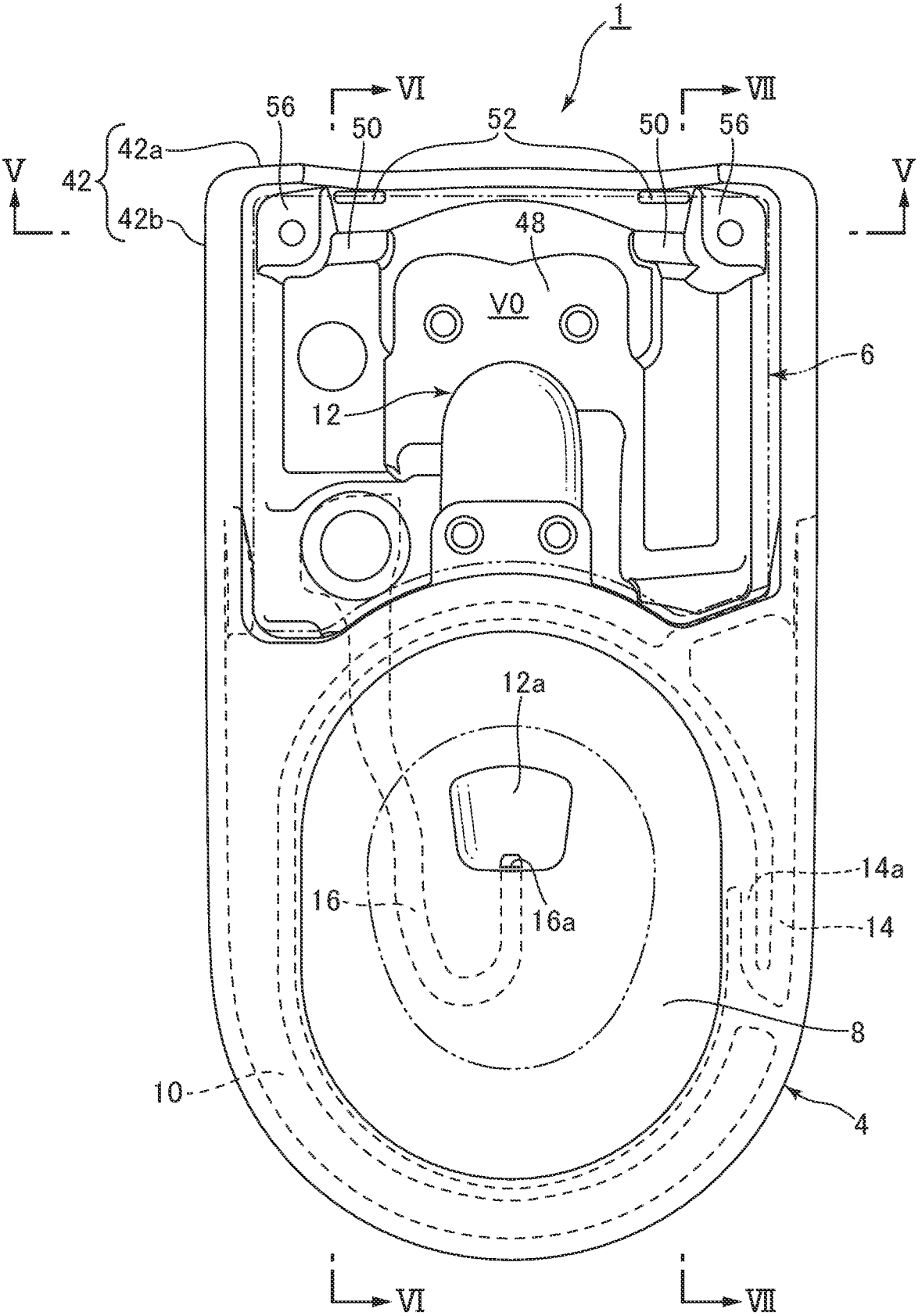
FIG. 2 is a plan view of the flush toilet according to the embodiment of the present invention.
Figure 3:
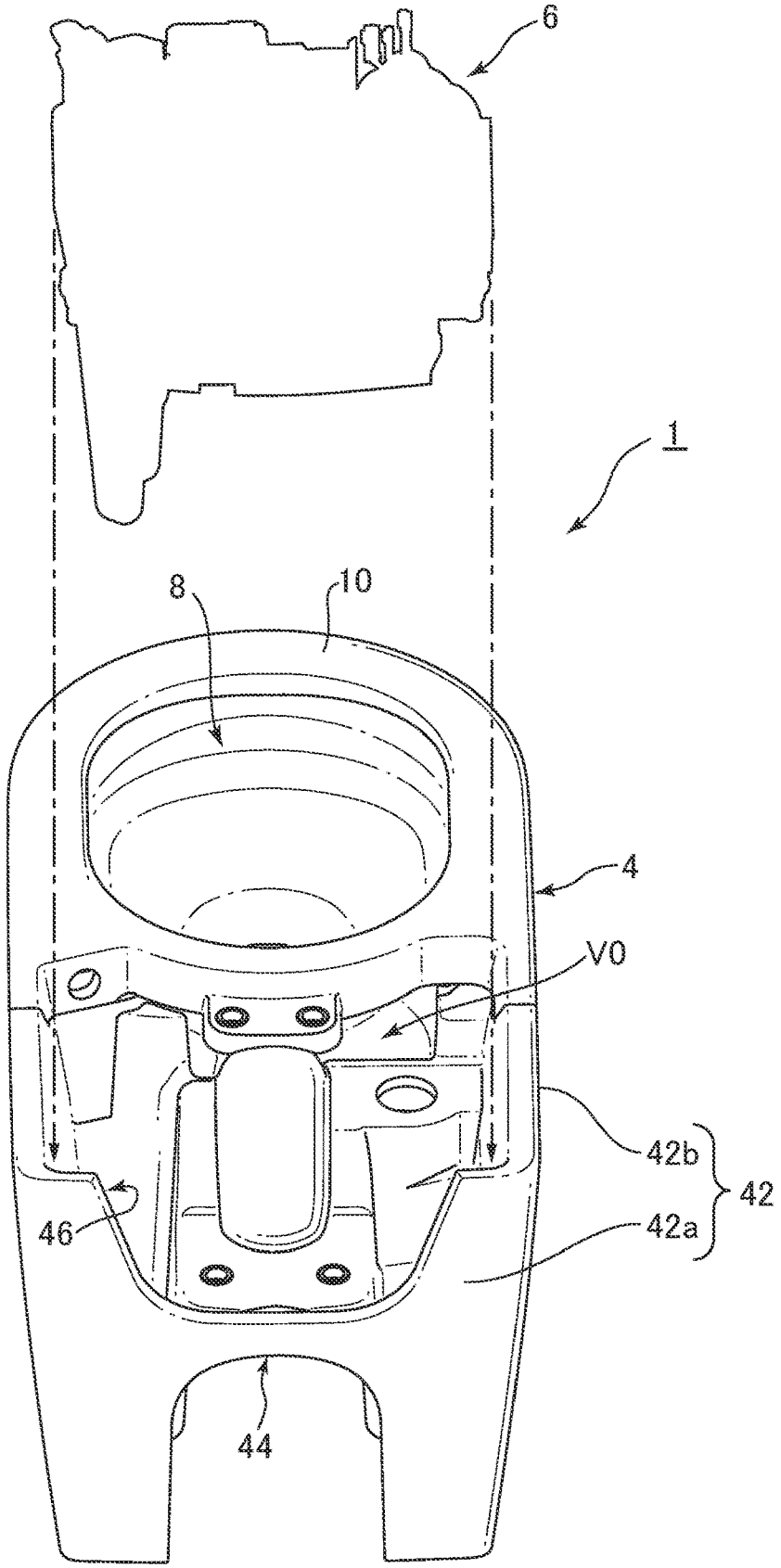
FIG. 3 is an exploded perspective view of the flush toilet according to the embodiment of the present invention seen from rear and diagonally above.

Hereinafter, a flush toilet according to an embodiment of the present invention will be described with reference to the accompanying drawings. First, an entire configuration of the flush toilet according to the embodiment of the present invention will be schematically described with reference to FIGS. 1 to 3. As shown in FIGS. 1 to 3, a flush toilet 1 according to the embodiment of the present invention includes a water supply channel (a main water passageway 2) where flush water that is supplied from a main water supply source W0 such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 2, a rim conduit 14 is formed in the rim 10 on one of left and right sides of the toilet main body 4 (right side of the toilet main body 4 seen from front). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front). Further, a rim spout port 14*a* is provided on a downstream end (downstream rear end) of the rim conduit 14. Furthermore, a rim-side water supply channel 2*a* of the flush water supply device 6, of which more later, is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. For its part, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an outlet 12*e* of the descending pipe 12*c* of the water discharge trap 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Consequently, a so-called water discharge mode of "wall side water discharge" is formed where water discharged through the outlet 12*e* of the water discharge trap 12 of the toilet main body 4 is discharged from the discharge socket S to the drain pipe D on a wall side. Additionally, the flush toilet 1 of the present embodiment is not limited to this water discharge mode of "wall side water discharge", and is applicable to a so-called water discharge mode of "floor side water discharge" where water discharged through the outlet 12*e* of the water discharge trap 12 of the toilet main body 4 is discharged from the discharge socket S to a drain pipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, in a mode where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on the downstream side of the branch part B on the downstream side of the main water passageway 2. Accordingly, flush water that is supplied from the main water supply source W0 to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 7. Here, the flush toilet 1 of the present embodiment shown in FIGS. 4 to 7 does not show the flush water supply device 6.

First, as shown in FIGS. 2 to 7, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4, to form a storage region that can store at least a part of the flush water supply device 6 (control unit).

Figure 4:
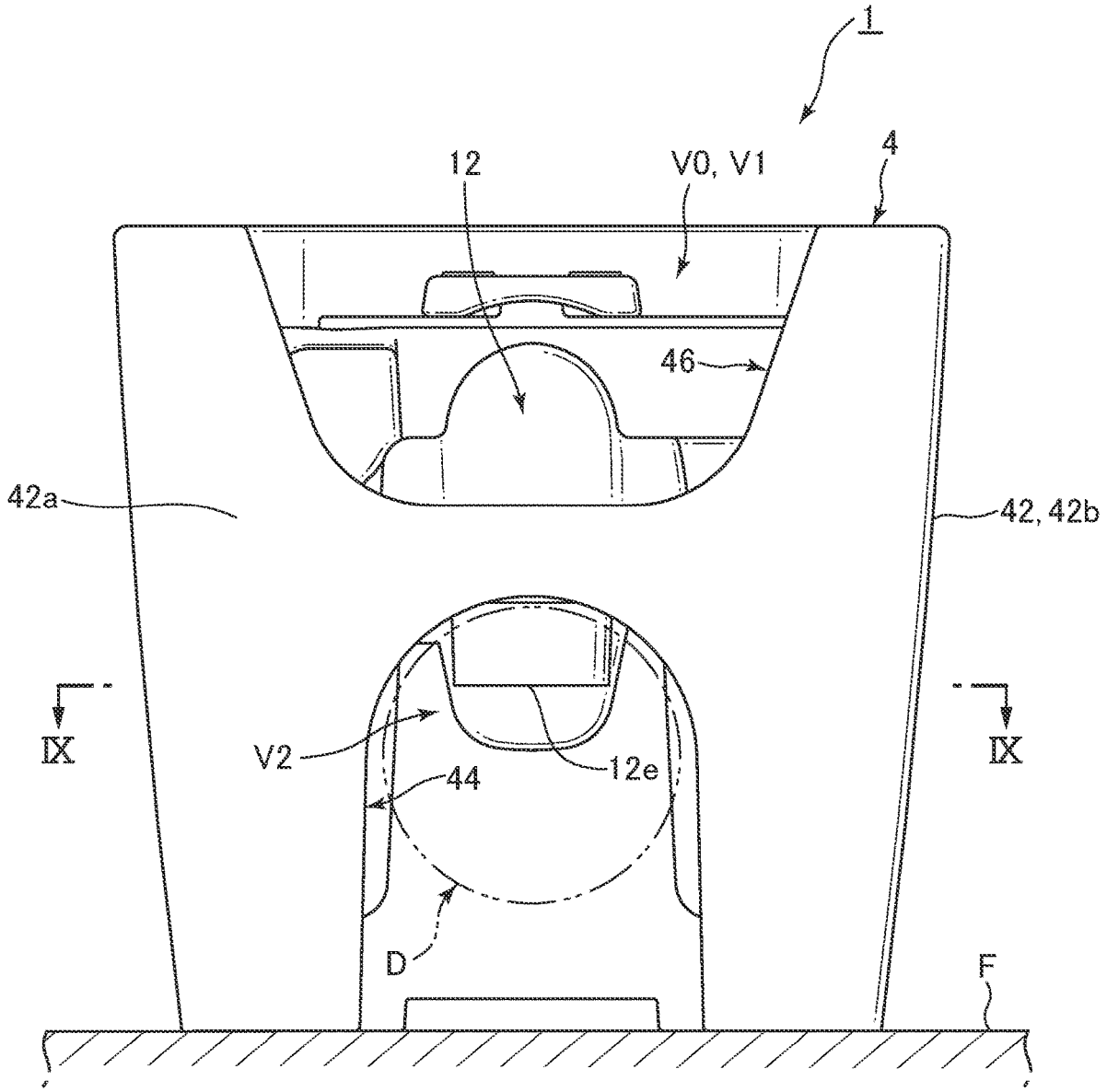
FIG. 4 is a back view of the flush toilet according to the embodiment of the present invention.
Figure 5:
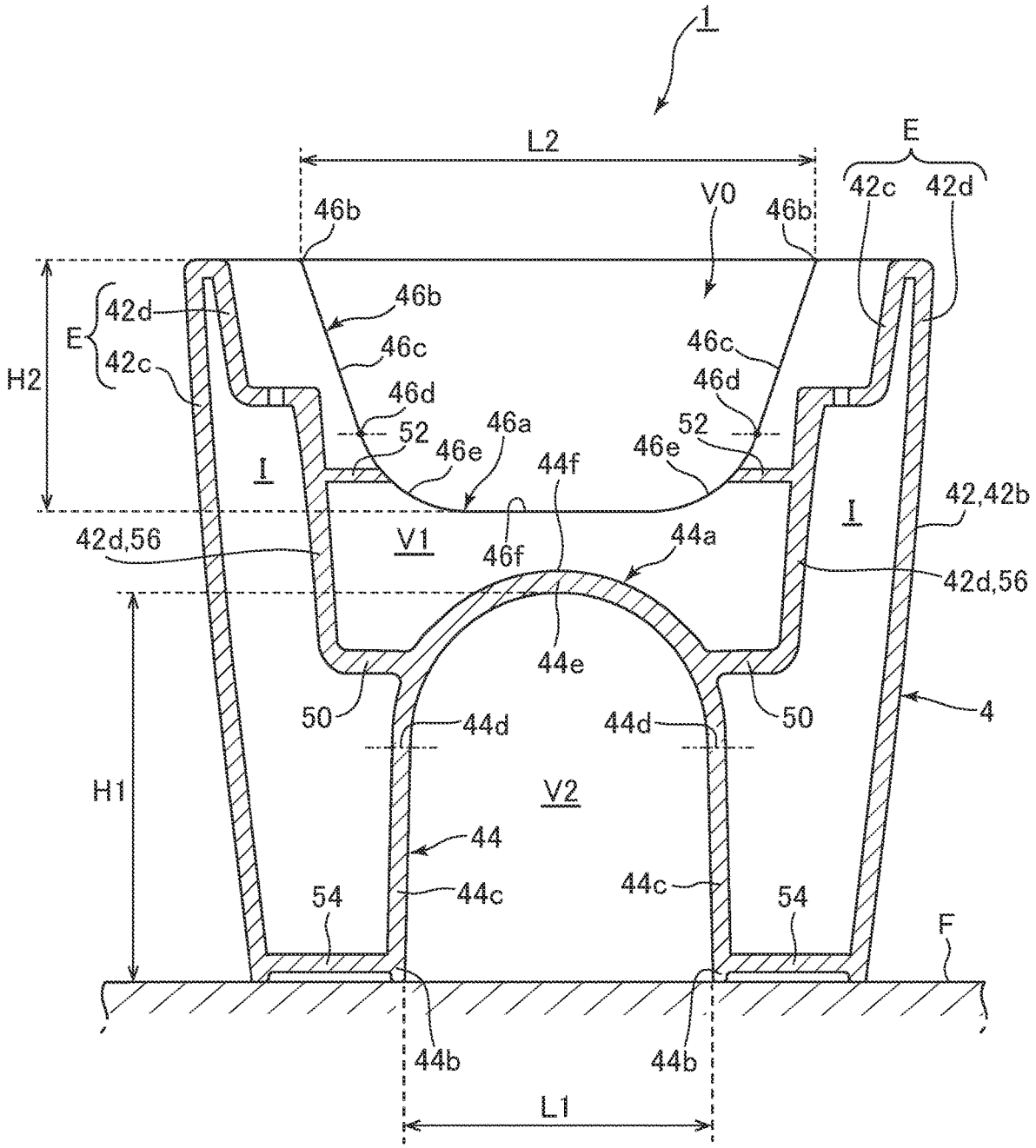
FIG. 5 is a cross-sectional view taken along a line V-V of FIG. 2.

Next, as shown in FIGS. 2 to 7, the skirt 42 includes a rear wall 42*a* provided on a back surface of the toilet main body 4, and a side wall 42*b* provided on each of left and right side surfaces of the toilet main body 4 seen from front. Here, as shown in FIG. 5, each of the rear wall 42*a* and the side wall 42*b* of the skirt 42 includes an outer wall 42*c* that forms an outer surface of the skirt 42, and an inner wall 42*d* provided inside the outer wall 42*c*. The outer wall 42*c* and the inner wall 42*d* form a double wall E. Also, the double wall E forms an internal space I between the outer wall 42*c* and the inner wall 42*d*.

Also, as shown in FIGS. 3 to 5, an opening (lower opening 44), to which the drain pipe D is connected, is formed penetrating, in a front-rear direction, a portion below a center of the rear wall 42*a* of the skirt 42 in a left-right direction seen from front. The lower opening 44 communicates between an outer region V2 (a region on an exit 12*e* side of the water discharge trap 12) below an inner region V1 of a rear storage V0 and an outer region behind the toilet main body 4. Further, as shown in FIGS. 4 and 5, an opening (upper opening 46) is formed penetrating the rear wall 42*a* of the skirt 42 in the front-rear direction above the lower opening 44 and behind a control unit (flush water supply device 6). The upper opening 46 communicates between the inner region V1 of the rear storage V0 (a storage region of the control unit (flush water supply device 6)) and the outer region behind the toilet main body 4. Also, a maximum dimension H1 of the lower opening 44 in an up-down direction is set to be larger than a maximum dimension H2 of the upper opening 46 in the up-down direction (H1>H2). Furthermore, a maximum dimension of the lower opening 44 in the left-right direction (a width dimension L1 between opposite lower ends 44*b* of the lower opening 44 in the left-right direction) is set to be smaller than a maximum dimension of the upper opening 46 in the left-right direction (a width dimension L2 between opposite upper ends 46*b* of the upper opening 46 in the left-right direction) (L1<L2). Consequently, when an own weight of the toilet main body 4 acts more noticeably on a lower part than on an upper part of the flush toilet 1 made of ceramics, a state where the lower opening 44 is easy to distort can be suppressed.

Next, as shown in FIGS. 2 and 5 to 7, the rear storage V0 includes a supporting wall 48 that supports the flush water supply device 6 (the control unit). The supporting wall 48 is attached to the water discharge trap 12 and divides, in an up-down direction, a storage region of the rear storage V0 into an upper region V1 and a lower region V2. Also, as shown in FIGS. 2 and 5 to 7, cross beams 50, 52 and 54 are provided between a peripheral edge of each opening (each of the lower opening 44 and the upper opening 46) in the rear wall 42*a* of the skirt 42 and the side wall 42*b* of the skirt 42. The cross beams 50, 52 and 54 can support the peripheral edges of the respective openings (the lower opening 44 and the upper opening 46) and the side wall 42*b* of the skirt 42 in such a manner that each peripheral edge and the side wall is joinable or couplable to each other and can reinforce strength of the toilet main body 4. Furthermore, the cross beams 50, 52 and 54 are arranged above or below each other. Note that in the present embodiment, a mode is described in which the respective cross beams 50, 52 or 54 are arranged on opposite left and right sides of each opening 44 or 46, but the cross beam 50, 52 or 54 may be provided on one of the left and right sides in accordance with a structure of the rear storage V0.

Furthermore, the cross beam 50 is provided to be joinable or couplable to the supporting wall 48 and formed of ceramics integrally with the toilet main body 4 made of ceramics. Also, a peripheral portion of each of the openings 44 and 46 is formed by a double wall E of each of the rear wall 42*a* and the side wall 42*b* of the skirt 42. Further, each of the cross beams 50, 52 and 54 joinably or coupleably supports the inner wall 42*d* of the double wall E of the skirt 42 and the peripheral edge of each of the openings 44 and 46. Note that the cross beam 52 that joinably or coupleably supports the inner wall 42*d* of the double wall E of the skirt 42 and the peripheral edge of the upper opening 46 may be omitted.

Next, as shown in FIGS. 4 and 5, the lower opening 44 of the rear wall 42*a* of the skirt 42 includes a protruding edge 44*a* having a top that substantially protrudes in an arch in back view. This arched protruding edge 44*a* includes a linear portion 44*c* that linearly extends from a start end (lower end 44*b*) of each of opposite left and right end portions toward a center of the rear wall 42*a* of the skirt 42 in the up-down direction or the left-right direction, and a curved portion 44*e* that curves upward from a terminal end (upper end 44*d*) of the linear portion 44*c*. Also, the cross beam 50 is disposed closer to a curved portion 44*e* side (upside) than to a connecting portion 44*d* between the linear portion 44*c* and the curved portion 44*e* of the opening 44 having a comparatively large curvature change. Thus, the cross beam 50 is provided to be joinable or couplable between the protruding edge 44*a* of the opening 44 and the side wall 42*b* of the skirt 42. Consequently, the cross beam 50 is provided below an uppermost surface 44*f* of the lower opening 44. On the other hand, the cross beam 54 is provided to be joinable or couplable between the lower end 44*b* of the lower opening 44 and a bottom portion of the side wall 42*b* of the skirt 42 outside the lower end in the left-right direction.

Similarly, as shown in FIGS. 4 and 5, the upper opening 46 in the rear wall 42*a* of the skirt 42 includes a protruding edge 46*a* having a bottom that substantially protrudes in an arch in back view. This arched protruding edge 46*a* includes a linear portion 46*c* that linearly extends from a start end (upper end 46*b*) of each of opposite left and right end portions toward the center of the rear wall 42*a* of the skirt 42 in the up-down direction or the left-right direction, and a curved portion 46*e* that curves downward from a terminal end (lower end 46*d*) of the linear portion 46*c*. Also, the cross beam 52 is disposed closer to a curved portion 46*e* side (downside) than to a connecting portion 46*d* between the linear portion 46*c* and the curved portion 46*e* of the opening 46 having a comparatively large curvature change. Thus, the cross beam 52 is provided to be joinable or couplable between the protruding edge 46*a* of the opening 46 and the side wall 42*b* of the skirt 42. Consequently, the cross beam 52 is provided above a lowermost surface 46*f* of the upper opening 46.

Figure 6:
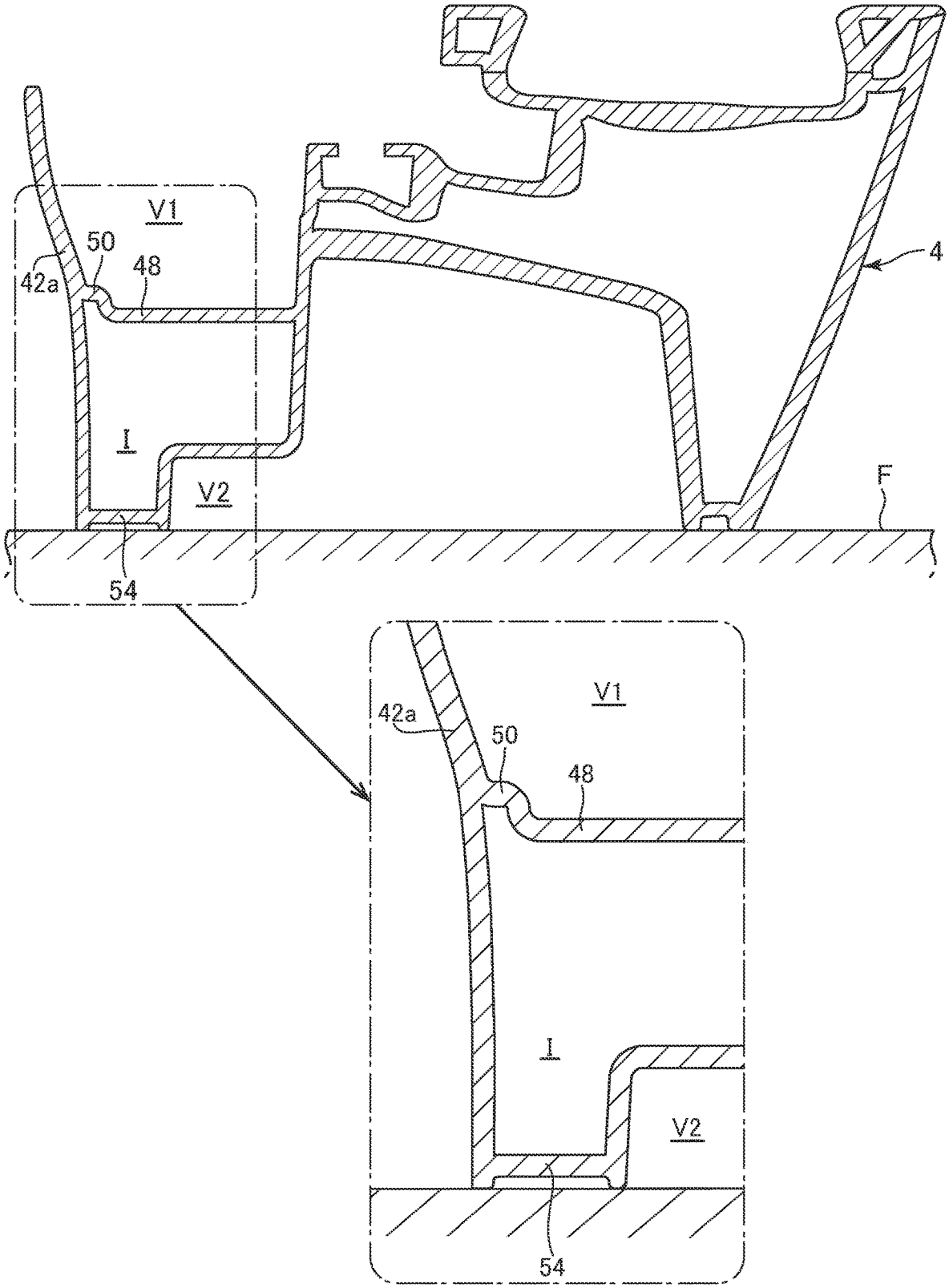
FIG. 6 is a cross-sectional view taken along a line VI-VI of FIG. 2.
Figure 7:
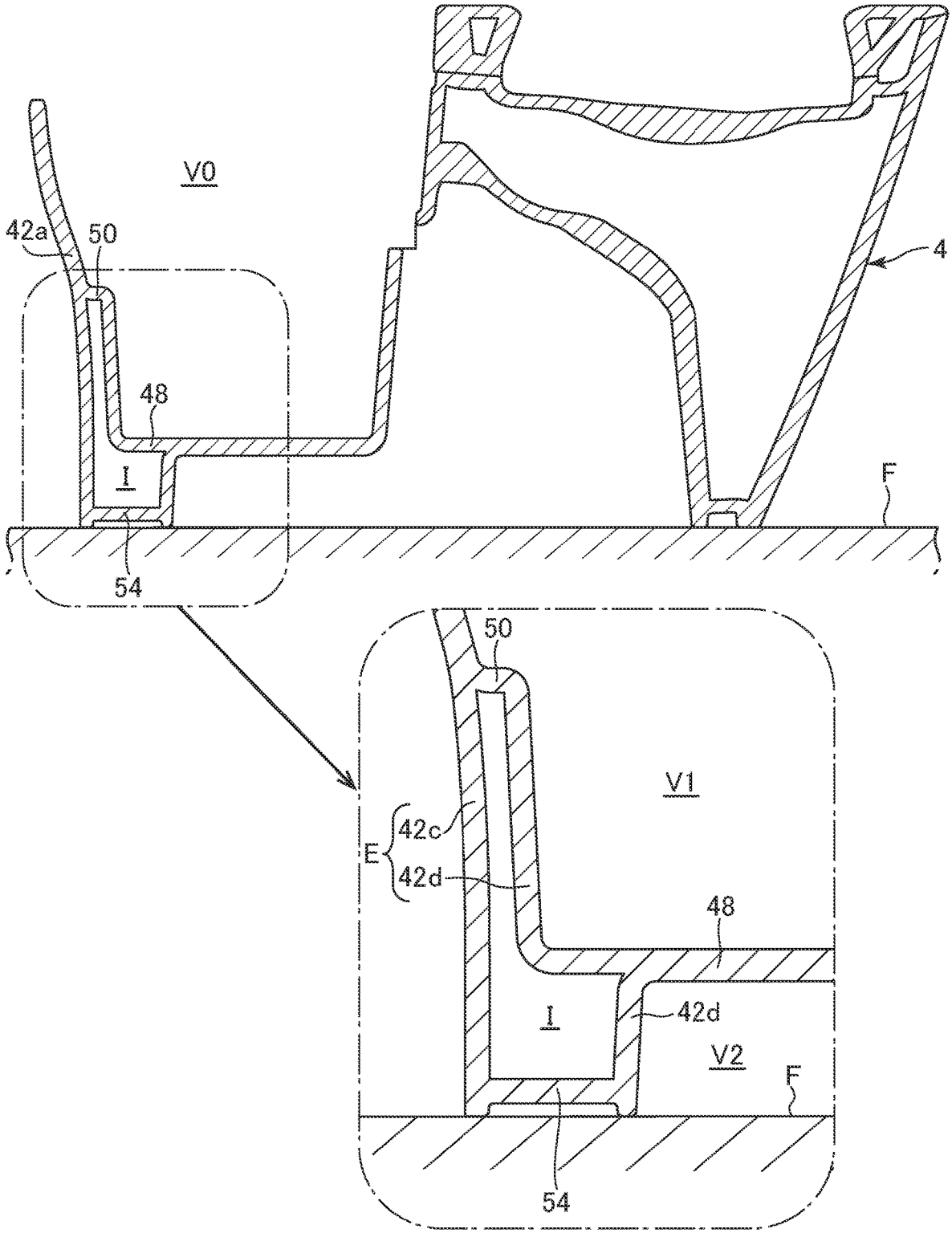
FIG. 7 is a cross-sectional view taken along a line VII-VII of FIG. 2.

Next, as shown in FIGS. 2 and 5, the skirt 42 includes a pair of left and right vertical beams 56 that joinably or coupleably support the rear wall 42*a* and the side wall 42*b*, between the rear wall and the side wall. Also, each vertical beam 56 is provided to be joinable or couplable to an outer end of the cross beam 50 in the left-right direction. Further, as shown in FIGS. 6 and 7, the cross beam 50 is provided to be joinable or couplable to the supporting wall 48 on a front side of the cross beam, and to be joinable or couplable to the rear wall 42*a* of the skirt 42 on a rear side of the cross beam.

Next, description will be given to operation of the flush toilet 1 according to the above embodiment of the present invention with reference to FIGS. 1 to 7. First, according to the flush toilet 1 of the embodiment of the present invention, the cross beam 50, 52, 54 provided between the peripheral edge of the opening 44, 46 in the rear wall 42*a* of the skirt 42 and the side wall 42*b* of the skirt 42 can joinably or coupleably support the peripheral edge of the opening 44, 46 and the side wall 42*b* of the skirt 42 and can reinforce the strength of the toilet main body 4. Consequently, even when a thickness of the rear wall 42*a* or the side wall 42*b* of the skirt 42 is not increased, the cross beam 50, 52, 54 can suppress deformation such as distortion of the opening 44, 46 itself, or suppress cuts, cracks or the like in a peripheral portion of the opening 44, 46 due to insufficient strength. Therefore, lack of strength in the toilet main body 4 can be suppressed, while acquiring a large storage region of the rear storage V0 of the toilet main body 4.

Next, according to the flush toilet 1 of the present embodiment, the rear wall 42*a* or the side wall 42*b* of the skirt 42 is formed by the double wall E including the inner wall 42*d* and the outer wall 42*c*. Therefore, the double wall E can form the rear wall 42*a* or the side wall 42*b* of the skirt 42 in a complicated shape and can increase strength. Also, the cross beam 50, 52, 54 can joinably or coupleably support the double wall E and the peripheral edge of the opening 44, 46, the double wall having comparatively high strength. This can effectively suppress deformation such as distortion of the opening 44, 46 itself and cuts, cracks or the like in the peripheral portion of the opening 44, 46 due to the insufficient strength.

Also, according to the flush toilet 1 of the present embodiment, the cross beam 50, 52, 54 is disposed closer to a curved portion 44*e*, 46*e* side than to the connecting portion 44*d*, 46*d* between the linear portion 44*c*, 46*c* and the curved portion 44*e*, 46*e*, the connecting portion having the comparatively large curvature change, in the arched protruding edge 44*a*, 46*a* of the opening 44, 46, and the cross beam is provided to be joinable or couplable between the protruding edge 44*a*, 46*a* of the opening 44, 46 and the side wall 42*b* of the skirt 42. This can more effectively suppress deformation such as distortion of the arched protruding edge 44*a*, 46*a* of the opening 44, 46 having the comparatively large curvature change, and cuts, cracks or the like in the peripheral portion of the opening 44, 46 due to insufficient strength.

Furthermore, according to the flush toilet 1 of the present embodiment, the skirt 42 includes the vertical beam 56 that joinably or coupleably supports the rear wall 42*a* and the side wall 42*b*, between the rear wall and the side wall in the skirt. Consequently, the cross beams 50, 52, 54 can suppress deformation such as distortion of the opening 44, 46, and cuts, cracks or the like in the peripheral portion of the opening 44, 46 due to the insufficient strength. Furthermore, the vertical beam 56 can reinforce strength of a joining portion between the rear wall 42*a* and the side wall 42*b* in the skirt 42, so that deformation such as distortion of the rear wall 42*a* or side wall 42*b* of the skirt 42 and damages due to insufficient strength can be suppressed.

Also, according to the flush toilet 1 of the present embodiment, the vertical beam 56 is also provided to be joinable or couplable to the cross beam 50, 52, 54, so that the vertical beam 56 can reinforce strength of the cross beam 50, 52, 54. Consequently, deformation such as distortion of the opening 44, 46 itself and cuts, cracks or the like in the peripheral portion of the opening 44, 46 due to the insufficient strength can be more effectively suppressed. Further, the deformation, such as the distortion, of the rear wall 42*a* or side wall 42*b* of the skirt 42 or the damages due to the insufficient strength can be more effectively suppressed.

Furthermore, according to the flush toilet 1 of the present embodiment, the cross beam 50, 52, 54 is provided to be joinable or couplable to the supporting wall 48 that forms the storage region that is available for storing the control unit (flush water supply device 6) above the supporting wall in the rear storage V0 and that supports the control unit (flush water supply device 6). Consequently, the supporting wall 48 and the cross beam 50, 52, 54 can more effectively suppress the deformation, such as the distortion, of the opening 44, 46 itself, and the cuts, cracks or the like in the peripheral portion of the opening 44, 46 due to the insufficient strength. Additionally, the deformation, such as the distortion, of the rear wall 42*a* or side wall 42*b* of the skirt 42 and the damages due to the insufficient strength can be more effectively suppressed.

Also, according to the flush toilet 1 of the present embodiment, the upper opening 46 that communicates between the inner region V1 of the rear storage V0 and the outer region behind the control unit (flush water supply device 6) of the toilet main body 4, and the lower opening 44 that is disposed below the upper opening 46 and that communicates between an exit 12*e* side region of the water discharge trap 12 and the outer region behind the toilet main body 4 are provided to the rear wall 42*a* of the skirt 42, so that operability through the upper opening 46 and lower opening 44 can improve. Further, the maximum dimension H1 of the lower opening 44 in the up-down direction is set to be larger than the maximum dimension H2 of the upper opening 46 in the up-down direction, so that a larger space on the exit 12*e* side of the water discharge trap 12 can be acquired. Consequently, for example, a larger space for connecting the discharge socket S, the drain pipe D and the like to the exit 12*e* of the water discharge trap 12 can be acquired, and hence construction properties can improve. Also, through the upper opening 46 in the rear wall 42*a* of the skirt 42, the control unit (flush water supply device 6) stored in the rear storage V0 can be disposed closer to the wall or the like behind the control unit, and a space behind the control unit (flush water supply device 6) can thus be effectively used. Furthermore, a larger storage region V1 of the rear storage V0 that stores the control unit (flush water supply device 6) can be acquired. Additionally, the strength can be increased, while suppressing a forward dimension of the whole toilet main body 4.

Furthermore, according to the flush toilet 1 of the present embodiment, the cross beam 50, 54 is provided below the uppermost surface 44*f* of the lower opening 44, and the cross beam 52 is provided above the lowermost surface 46*f* of the upper opening 46. Consequently, each of the cross beams 50, 52 and 54 can effectively suppress deformation such as distortion of the lower opening 44 or the upper opening 46 itself, and cuts, cracks or the like in a peripheral portion of the lower opening 44 or the upper opening 46 due to insufficient strength.

According to the flush toilet 1 of the present embodiment, the plurality of cross beams 50, 52 and 54 are provided to be joined to the peripheral edges of the openings 44 and 46, and the respective cross beams 50, 52 and 54 are arranged above or below each other. Consequently, the cross beam 50, 52, 54 can effectively suppress the deformation, such as the distortion, of the opening 44, 46 itself, and the cuts, cracks or the like in the peripheral portion of the opening 44, 46 due to the insufficient strength. Therefore, lack of strength in the whole toilet main body 4 can be suppressed.

Note that a mode is described in which each of the cross beams 50, 52 and 54 and the vertical beam 56 of the flush toilet 1 according to the above embodiment of the present invention is provided integrally with ceramics to the toilet main body 4 made of ceramics, but this mode is not restrictive, and a separate member from the toilet main body 4 made of ceramics may be adopted.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste and a water discharge trap configured to discharge the waste in the bowl, the water discharge trap including an inlet connected to a lower portion of the bowl, a control unit provided more rearward than the bowl of the toilet main body, the control unit being configured to control discharge and stopping of flush water to the bowl, and wherein the toilet main body further includes a skirt and a rear storage configured to store at least a part of the control unit, the skirt being formed on an outer side of side surfaces of the bowl and the water discharge trap, and a rear storage being provided inside the skirt in a region more rearward than the bowl, the skirt includes a rear wall and a side wall provided in a back surface and a side surface of the toilet main body, respectively, and the rear wall includes an opening provided penetrating in a front-rear direction to communicate between an outer region behind the toilet main body and an inner region of the rear storage or an outer region below the inner region and, and the skirt further includes a cross beam provided between a peripheral edge of the opening and the side wall of the skirt, and the cross beam joinably or coupleably supports the peripheral edge of the opening and the side wall of the skirt to each other so as to reinforce strength of the toilet main body.

2. The flush toilet according to claim 1, wherein the rear wall or the side wall of the skirt forms a double wall including an outer wall and an inner wall, the outer wall forms an outer surface of the double wall, the inner wall is provided inside the outer wall, and the double wall has at least a part forming an internal space between the outer wall and the inner wall, a peripheral portion of the opening is formed by the double wall, and the cross beam joinably or coupleably supports the inner wall of the double wall and the peripheral edge of the opening.

3. The flush toilet according to claim 1, wherein the opening includes a protruding edge having one of a top or a bottom, the protruding edge substantially protrudes in an arch in back view, the arched protruding edge includes a linear portion and a curved portion, the linear portion linearly extends from a start end of each of opposite left and right end portions of the protruding edge toward a terminal end in a center of the rear wall of the skirt in an up-down direction or a left-right direction, and the curved portion curves upward or downward from the terminal end of the linear portion, and the cross beam is disposed closer to the curved portion than to a connecting portion between the linear portion and the curved portion, the connecting portion having a comparatively large curvature change, and the cross beam is provided to be joinable or couplable between the protruding edge of the opening and the side wall of the skirt.

4. The flush toilet according to claim 1, wherein the skirt includes a vertical beam between the rear wall and the side wall so as to joinably or coupleably support the rear wall and the side wall.

5. The flush toilet according to claim 4, wherein the vertical beam is provided to be joinable or couplable to the cross beam.

6. The flush toilet according to claim 1, wherein the rear storage includes a supporting wall supporting the control unit, and the supporting wall forms a storage region configured to store the control unit above the supporting wall, and the cross beam is provided to be joinable or couplable to the supporting wall.

7. The flush toilet according to claim 1, wherein the opening includes an upper opening and a lower opening disposed below the upper opening, and the upper opening penetrates the rear wall of the skirt in the front-rear direction to communicate between the inner region of the rear storage and the outer region behind the toilet main body, and the lower opening penetrates the rear wall of the skirt in the front-rear direction to communicate between an exit side region of the water discharge trap and the outer region behind the toilet main body.

8. The flush toilet according to claim 7, wherein a maximum dimension of the lower opening in an up-down direction is larger than a maximum dimension of the upper opening in the up-down direction.

9. The flush toilet according to claim 7, wherein the cross beam is provided above a lowermost surface of the upper opening or below an uppermost surface of the lower opening.

10. The flush toilet according to claim 1, wherein a plurality of cross beams are provided to be joined to the peripheral edge of the opening, and the respective cross beams are arranged above or below each other.

* * * * *